United States Patent [19]

Davis

[11] 4,449,639

[45] May 22, 1984

[54] TAMPER-RESISTANT AND CHILD-RESISTANT CLOSURES

[75] Inventor: Eugene E. Davis, Ilford, England

[73] Assignee: Johnsen & Jorgensen (Plastics) Ltd., London, England

[21] Appl. No.: 470,508

[22] Filed: Feb. 28, 1983

[30] Foreign Application Priority Data

Dec. 13, 1982 [GB] United Kingdom ..... 8235409

[51] Int. Cl.[3] ..... B65D 55/02

[52] U.S. Cl. ..... 215/224; 215/256; 215/258

[58] Field of Search ..... 215/224, 225, 256, 258

[56] References Cited

U.S. PATENT DOCUMENTS 4,071,156 1/1978 Lowe ..... 215/224

4,417,666 11/1983 Roberts ..... 215/256

*Primary Examiner*—George T. Hall

*Attorney, Agent, or Firm*—Barnes & Thornburg

[57] ABSTRACT

This invention provides a closure which is both tamper-resistant and child-resistant. The closure has a cap part including a top and a skirt, a tear band and a captive band, the tear band being connected to the skirt and to the captive band by lines of weakness and tell tale bridge members are provided so that the tear band cannot be removed without breaking the bridge members to provide the tamper-resistant feature. To provide the child-resistant feature the skirt of the cap part has an internal projection which can pass through an opening in an arcuate bead on an associated container only when the cap part is turned into a predetermined position.

10 Claims, 8 Drawing Figures

TAMPER-RESISTANT AND CHILD-RESISTANT CLOSURES

This invention is concerned with the provision of tamper-resistant and child-resistant closures specially designed to fit containers of known outer shape. The closures are particularly intended for use with containers for holding pills, tablets or other medicaments. Many millions of such containers are made and sold every year and manufacturers have a very substantial existing investment in moulds for making the known containers. It is for that reason that we have directed our attention to the provision of closures that will fit the existing containers or will fit the existing containers with relatively slight and inexpensive modification to the containers. Broadly speaking, the known containers can be divided, for consideration, into two parts, a body part to hold the product and a neck shaped for engagement by the closure. The known containers have bodies of differing size and shape to suit requirements but the neck part has always had a substantially standard profile including an external bead or beads for engagement by the closure.

One known container has been used in U.S.A. to hold pain killing tablets known under the Registered Trade Mark TYLENOL. This container is in the form of a bottle which has a neck profile on which our new closure will fit. Hitherto the known TYLENOL container has been provided with a closure known under the Registered Trade Mark SNAP SAFE which is child-resistant but not tamper-resistant. Various adaptations of that kind of closure have been proposed in the past e.g. in Martin's U.S. Pat. No. 2,827,193, in Diamonds U.K. Pat. No. 1,295,207 and in Owens-Illinois U.K. Pat. No. 1,521,201. One known form of container neck has a substantially vertical annular rim around an open mouth, a substantially horizontal annular ledge below the rim, two annular recesses and projections below the ledge terminating in an annular flange below which the neck merges into the container body which in the case of the TYLENOL container is in the form of a bottle but which can in fact be of any desired shape. It must be said that it had been assumed by manufacturers that it was important to guard against children getting easy access to the contents of a medicament container but, on the other hand, the risk of the medicament being tampered with after packing and closing of the container was minimal. Recent events in U.S.A. have shown that the tampering risk is, in fact, a real one and it is the chief object of this invention to provide a closure that is tamper-resistant as well as child-resistant and that can be fitted to known containers.

By tamper-resistant we mean a closure that cannot be removed from the container, when the container is opened for the first time, without leaving clear evidence that the closure has been removed and replaced as in the case of our JAYCAP closure.

According to the present invention there is provided a closure for a container which has a hollow body and a mouth through which access can be obtained to the inside of the body, a rim around the mouth and a substantially horizontal outwardly projecting arcuate bead below the rim, wherein the closure has a cap part with a depending skirt, at the top, a tear band in the middle and a captive band at the bottom and wherein the tear band is connected to the skirt of the cap part and to the captive band by lines of weakness to facilitate tearing away of the tear band, the skirt of the cap part having an internal projection which can pass through the opening in the arcuate bead on the container so that the internal projection can cooperate with the projecting bead in such a way that the cap part can be removed only when the projection is in vertical alignment with the opening characterised by the provision of a tell tale bridge member which is normally intact but which is broken when the tear band is removed to give immediate visual evidence that the contents of the container may have been tampered with.

The importance of the presence of at least one bridge member is that it is just possible to tear away a tear band, open the container and then to replace the tear band to give an appearance that it has never been removed but it is virtually impossible to disguise the fact that a tell tale bridge member has been broken. Preferably we provide at least one bridge member spanning both lines of weakness.

In order that the invention may be more clearly understood, reference is now directed to the accompanying drawings given by way of example in which.

Figure 1:
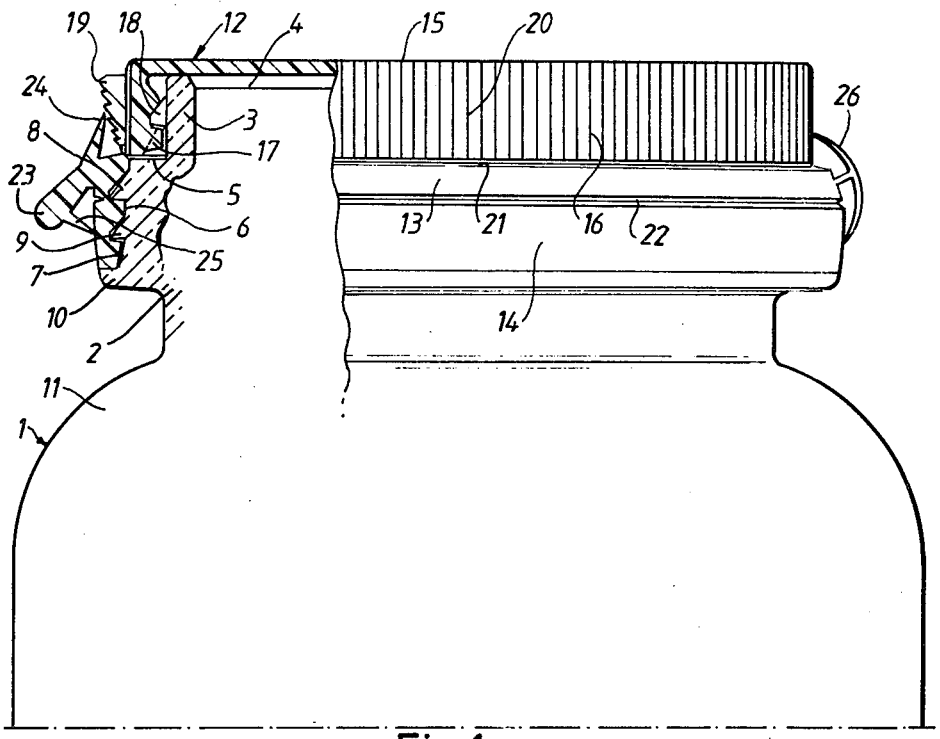
FIG. 1 is a side elevation, partly in section, of a closure in accordance with the invention, in its operative position.
Figure 2:
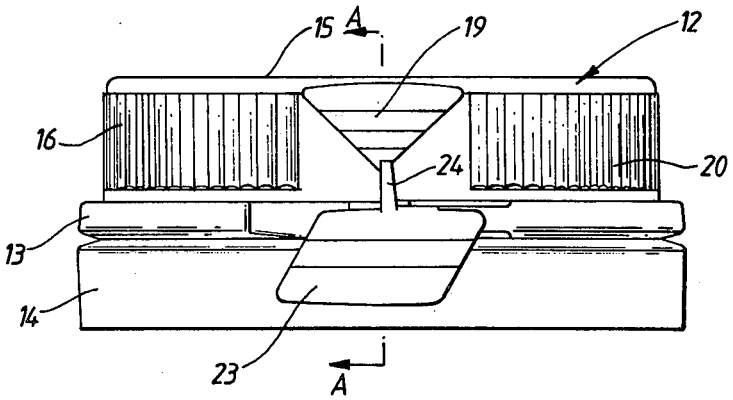
FIGS. 2 and 3 are side elevations of a slightly modified form of closure.
Figure 3:
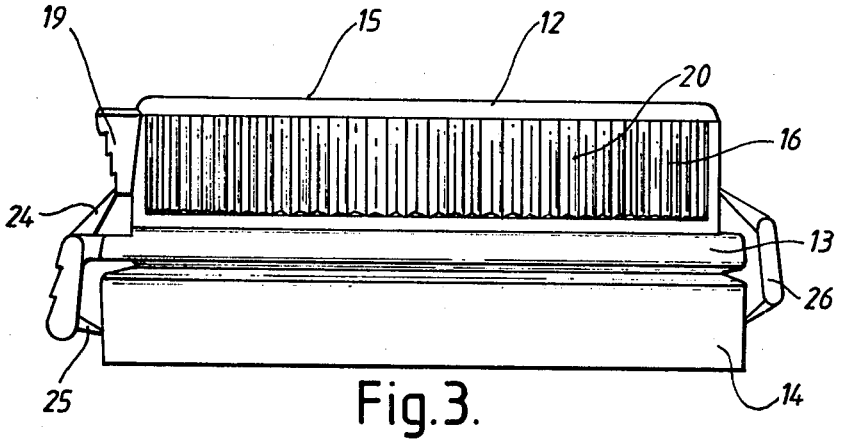
Figure 4:
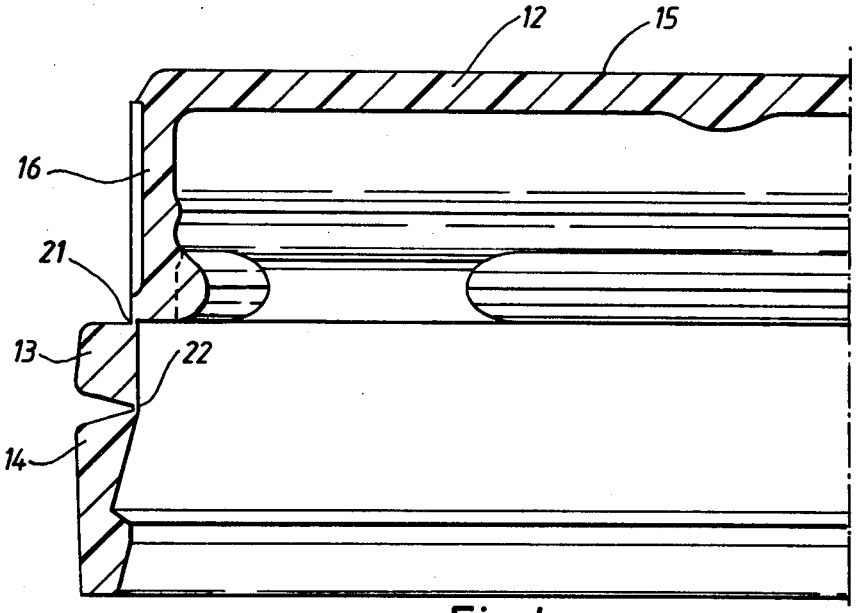
FIG. 4 is a part-sectional view of the closure of FIGS. 2 and 3, taken on the line B—B of FIG. 5.
Figure 5:
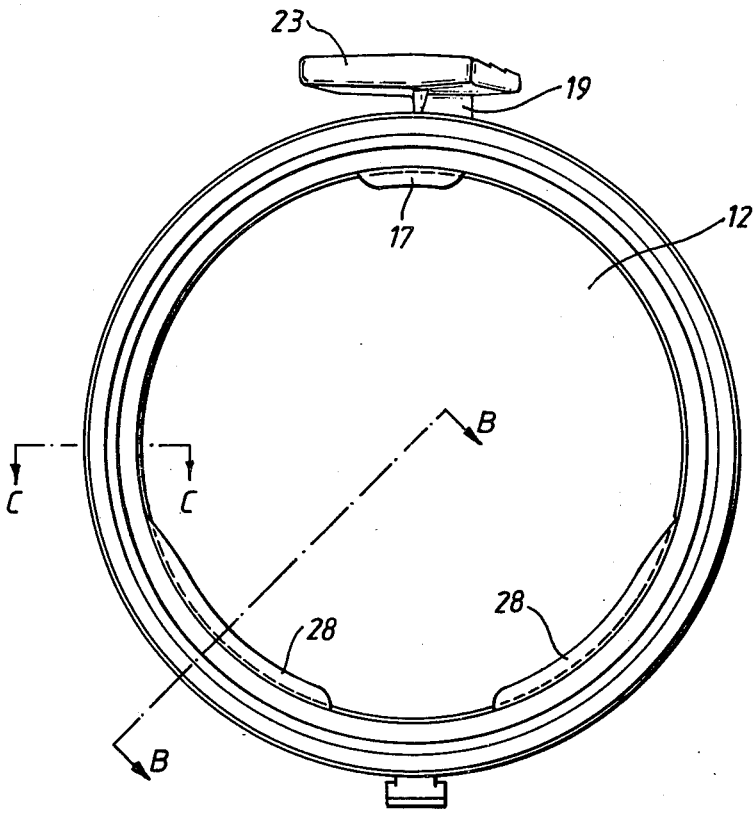
FIG. 5 is an underneath plan view.
Figure 6:
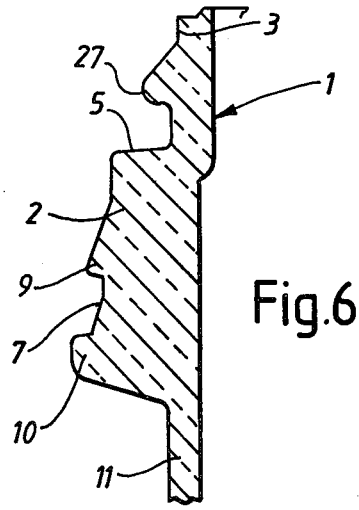
FIG. 6 is a view of a neck profile of a container with which the closure of FIGS. 2 to 5 may be used and FIGS. 7 and 8 are respectively sectional views on the lines A—A of FIG. 2 and C—C of FIG. 5.
Figure 7:
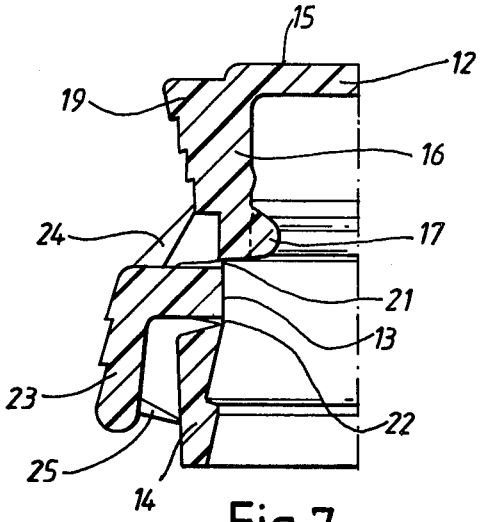
Figure 8:
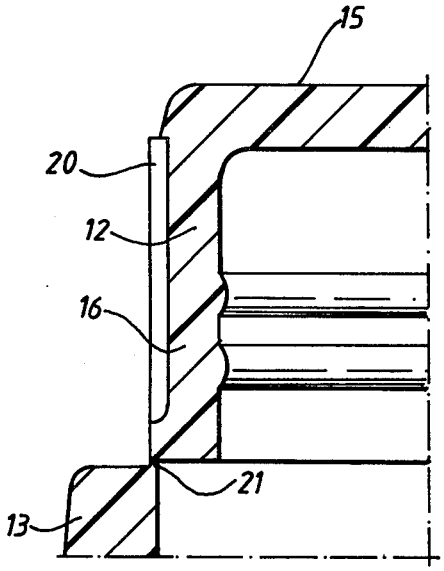

Referring first to FIG. 1 it will be seen that the container 1 has a neck 2 with a rim 3 around the mouth 4,a ledge 5 below the rim 3, two annular external recesses 6 and 7 and projections 8 and 9 below the ledge and an annular flange 10 below which the neck 2 merges into the body 11 of the container 1. Naturally the body 11 can be of any desired size and shape.

The closure comprises three parts, a cap part 12 at the top, a tear band 13 in the middle and a captive band 14 at the bottom. The cap part 12 has a top 15 and an annular depending skirt 16. The cap part 12 also has an arcuate internal lug 17 to engage below an arcuate external projection 18 on the rim 3 of the container so that when the lug 17 and the projection 18 are in engagement the cap part 12 cannot be removed even if the tear band 13 has been torn away. Rotation of the cap part is required until the lug 17 disengages from the projection 18 to free the cap part for removal (after tearing away the band 13). A serrated tab 19 is provided on the skirt which may be used to assist in rotation of the cap part but is provided mainly to facilitate removal of the cap and serrations 20 are provided on the skirt. The tear band 13 seats on a sloping upper surface of the projection 8 and is connected to the skirt 16 of the cap part and to the captive band 14 respectively by lines of weakness 21,22 so that the band 13 can be torn away when it is required to gain access to the container for the first time.

The captive band 14 has a recess into which the projection 9 fits and the tear band 13 is sloped to provide a second recess, substantially in alignment with the line of weakness 22, into which the projection 8 fits, as shown. The tear band 13 is provided with a tear tab 23 which is connected to the serrated tab 19 by a frangible tell tale bridge member 24 and to the captive band 14 by a frangible tell tale bridge member 25. A further tell tale bridge member 26 is also provided and is frangibly connected to the cap part, to the tear band and to the captive band.

It will be understood that the members 17, 18 form the child-resistant feature and the tear band with the tell tale members form the tamper-resistant feature.

The closure is made, preferably by moulding as one integral unit from resilient material such as a suitable plastics material so that the closure can be pushed downwardly into operative position. During the downward movement the bands 13 and 14 deform outwardly and then spring back into the position shown in the drawing. When in operative position the cap part cannot be removed until the tear band has been torn away and if the tear band be removed by an unauthorised person the fact that it has been removed is obvious due to the absence of the tear band and the broken bridge members. An attempt to replace a torn tear band cannot succeed because it really is impossible to reconnect the bridge members successfully.

To open the container for the first time it is necessary to grip the tab 23 and to tear away the tear band 13 leaving the captive band 14 in position. Tearing and removal of the band 13 breaks and removes the bridge members which fall away with the band 13. The cap part can then be angularly displaced to free the bead 17 from the projection 18 after which the cap part can be removed by an upward push on the tab 19.

Referring not to FIGS. 2 to 8 it will be seen that the container 1 this time has a neck 2 with a rim 3 around the mouth 4, a ledge 5 below the rim 3 and a single annular external recess 7 and a single external projection 9 below the ledge. The container also has a flange 10, as before, below which the neck 2 merges into the body 11 of the container 1. The container 1, in this embodiment has an annular projecting external bead 27 on the rim 3 for engagement with internal arcuate members 28 on the closure so that the closure does not simply fall off after the tear band has been removed.

The closure, as before, comprises three parts, a cap part 12 at the top, a tear band 13 in the middle and a captive band 14 at the bottom, the cap part 12 having a top 15 and a skirt 16. The arcuate depending lug 17 engages with the projection 18 (not shown in FIG. 6) until the cap part is angularly displaced to free the cap part for removal (after tearing away the band 13). The serrated tab 19 and the serrations 20 are provided in substantially the same manner as in the first embodiment. An annular internal recess in the captive band 14 engages with the projection 9, when the closure is in position but the inner surface of the band 13, in this case, lies flush against a flat part of the external surface of the container.

Lines of weakness 21, 22 are provided to facilitate tearing away of the band 13 using a tear tab 23 which is connected to the tab 19 and to the band 14 by frangible tell tale bridge members 24, 25. The closure is also provided with a tell tale bridge member 26.

It will be understood that an appropriate indication will preferably be given so that a user will know when the cap part has been turned into the correct position for removal. This can be done by providing an upward pointing arrow on the outer surface of the container pointing to the middle of the opening in the arcuate projection 18 and a downwardly pointing arrow on the skirt of the container to indicate the position of the lug 17. The arrow on the skirt is preferably provided by shaping the tab 19 as shown. With this arrangement a user simply has to line up the two arrows, after tearing away the band 13, to bring the cap into position for removal.

I claim:

1. A closure for a container which has a hollow body and a mouth through which access can be obtained to the inside of the body, a rim around the mouth and a substantially horizontal outwardly projecting arcuate bead below the rim, wherein the closure has a cap part with a depending skirt, at the top, a tear band in the middle and a captive band at the bottom and wherein the tear band is connected to the skirt of the cap part and to the captive band by lines of weakness to facilitate tearing away of the tear band, the skirt of the cap part having an internal projection which can pass through the opening in the arcuate bead on the container so that the internal projection can cooperate with the projecting bead in such a way that the cap part can be removed only when the projection is in vertical alignment with the opening characterised by the provision of a tell tale bridge member which is normally intact but which is broken when the tear band is removed to give immediate visual evidence that the contents of the container may have been tampered with.

2. A closure according to claim 1 characterised in that the bridge member is connected to the cap part, to the tear band and to the captive band so that the bridge member spans both lines of weakness.

3. A closure for a container which has a hollow body and a mouth through which access can be obtained to the inside of the body, a rim around the mouth and a substantially horizontal outwardly projecting arcuate bead below the rim, wherein the closure has a cap part with a depending skirt, at the top, a tear band in the middle and a captive band at the bottom and wherein the tear band is connected to the skirt of the cap part and to the captive band by lines of weakness to facilitate tearing away of the tear band, the skirt of the cap part having an internal projection which can pass through the opening in the arcuate bead on the container so that the internal projection can cooperate with the projecting bead in such a way that the cap part can be removed only when the projection is in vertical alignment with the opening characterised by the provision of tell tale bridge members which are normally intact but which are broken when the tear band is removed to give immediate visual evidence that the contents of the container may have been tampered with.

4. A closure according to claim 1 characterised in that the bridge members are connected to the cap part, to the tear band and to the captive band so that the bridge members span both lines of weakness.

5. A closure according to claim 1 characterised in that the bridge member has an upper arm connecting a tear tab on the tear band to a tab on the cap part and a lower arm connecting the tear tab to the captive band.

6. A closure according to claim 3 characterised in that one of the bridge members has an upper arm connecting a tear tab on the tear band to a tab on the cap part and a lower arm connecting the tear tab to the captive band.

7. A closure according to claim 1 characterised in that the bridge member has an upper arm connecting the tear band to the skirt of the cap part and a lower arm connecting the tear band to the captive band.

8. A closure according to claim 3 characterised in that a first bridge member has an upper arm connecting a tear tab on the tear band to a tab on the cap part and a lower arm connecting the tear tab to the captive band and a second bridge member has an upper arm connecting the tear band to the skirt of the cap part and a lower arm connecting the tear band to the captive band.

9. A closure according to claim 7 characterised in that the bridge member is disposed diametrically opposite to a tear tab on the tear band.

10. A closure according to claim 3 characterised in that a first bridge member has an upper arm connecting a tear tab on the tear band to a tab on the cap part and a lower arm connecting the tear tab to the captive band and a second bridge member has an upper arm connecting the tear band to the skirt of the cap part and a lower arm connecting the tear band to the captive band, the first and second bridge members being disposed in diametrically opposed positions.

* * * * *